United States Patent [19]

Lin

[11] Patent Number: 4,705,387

[45] Date of Patent: Nov. 10, 1987

[54] CLEANING APPARATUS FOR CHARGE RETENTIVE SURFACE

[75] Inventor: Ying-wei Lin, Penfield, N.Y.

[73] Assignee: Xerox Corporation, Stamford, Conn.

[21] Appl. No.: 563,729

[22] Filed: Dec. 21, 1983

[51] Int. Cl.[4] ..... G03G 21/00

[52] U.S. Cl. ..... 355/15; 15/1.5 R; 15/256.52; 118/652; 361/233

[58] Field of Search ..... 355/15; 15/256.5, 256.51, 15/256.52, 1.5; 118/652; 361/233

[56] References Cited

U.S. PATENT DOCUMENTS

| | | | |
|---|---|---|---|
| 3,572,923 | 3/1971 | Fisher et al. | 355/15 |
| 3,580,673 | 5/1971 | Yang | 355/15 |
| 3,722,018 | 3/1973 | Fisher | 15/1.5 |
| 3,778,678 | 12/1973 | Masuda . | |
| 3,801,869 | 4/1974 | Masuda . | |
| 3,872,361 | 3/1975 | Masuda . | |
| 4,007,982 | 2/1977 | Stange | 355/15 |
| 4,097,140 | 6/1978 | Suzuki et al. | 355/15 |
| 4,116,555 | 9/1978 | Young et al. | 355/15 |
| 4,172,303 | 10/1979 | Wooding | 355/15 X |
| 4,265,990 | 5/1981 | Stolka et al. | 430/59 |
| 4,279,499 | 7/1981 | Rezanka et al. | 355/15 |
| 4,376,578 | 3/1983 | Tanaka et al. | 355/15 |
| 4,402,103 | 9/1983 | Yanagawa et al. | 15/256.52 |
| 4,423,950 | 1/1984 | Sagami | 361/233 X |
| 4,502,780 | 3/1985 | Suzuki et al. | 355/15 |
| 4,530,597 | 7/1985 | Itaya et al. | 355/15 |

*Primary Examiner*—R. L. Moses

[57] ABSTRACT

Apparatus for removing residual charged particles from a charge retentive surface characterized by a particle removal roller and a detoning roller, the former of which is adapted to remove the residual particles from the charge retentive surface and the latter of which removes the particles transferred to the particle removal roller. The detoning roller comprises an array of conductive electrodes extending about the circumference thereof such that when a multi-phase power source is applied thereto a travelling electrostatic wave is generated which causes charged particles having a predetermined diameter and charge to be moved axially of the detoning roller towards one end thereof. The particles so moved represent toner devoid of paper debris. Thus they are suitable for reuse.

17 Claims, 2 Drawing Figures

CLEANING APPARATUS FOR CHARGE RETENTIVE SURFACE

Figure 1:
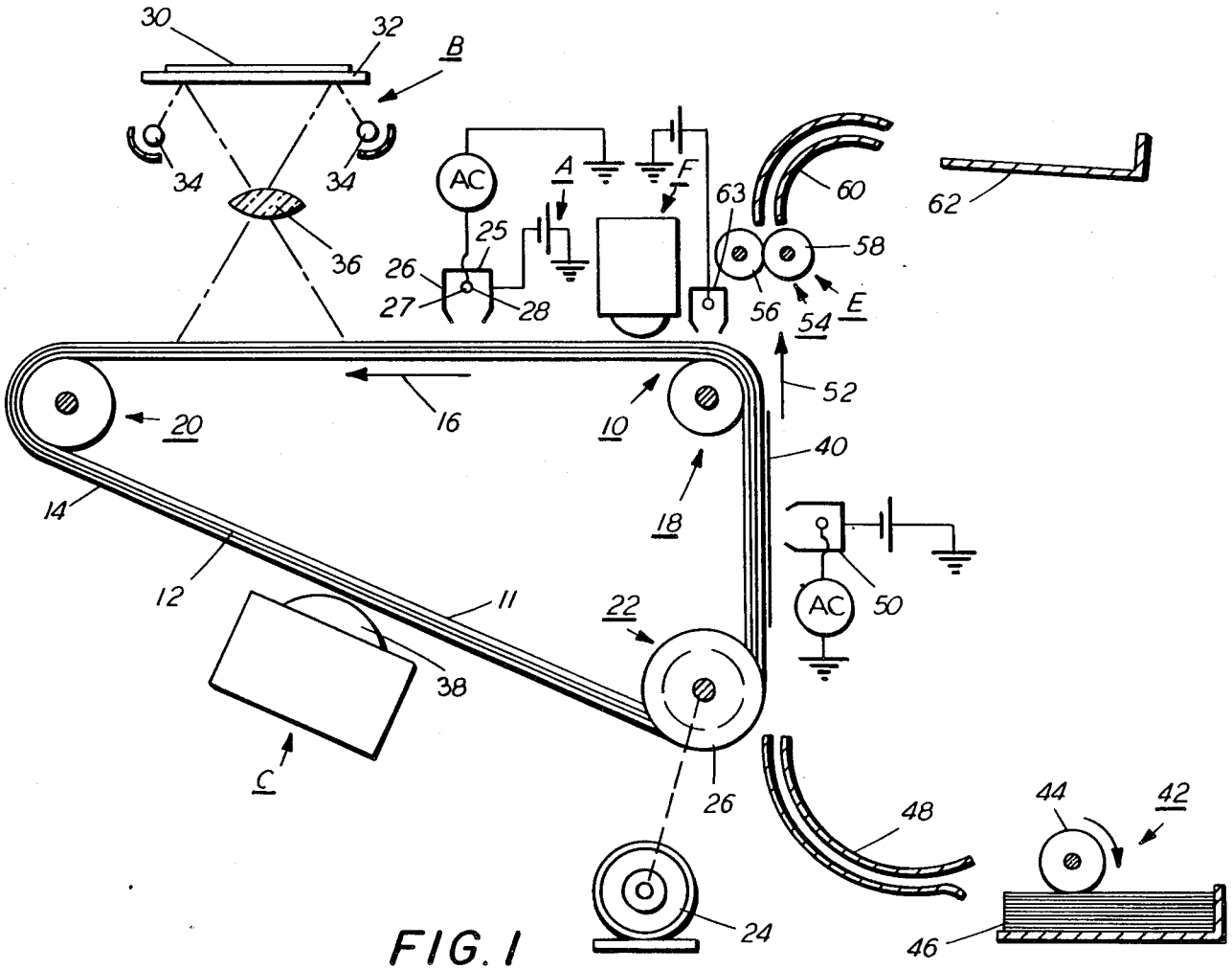

This invention relates to printing apparatus and more particularly to cleaning apparatus for removing residual particles such as toner and debris from a charge retentive surface forming a part of the printing apparatus with subsequent electrostatic recovery of toner suitable for reuse from the residual particles.

In printing arts of the type contemplated, one method of forming images using a charge retentive surface such as a photoreceptor or photoconductor. It comprises a photoconductive insulating material adhered to a conductive backing which is charged uniformly. Then the photoreceptor is exposed to a light image of an original document to be reproduced. The latent electrostatic images, thus formed, are rendered visible by applying any one of numerous pigmented resins specifically designed for this purpose. In this case of a reusable photoreceptor, the pigmented resin, more commonly referred to as toner which forms the visible images is transferred to plain paper. After transfer, the toner images are made to adhere to the copy medium usually through the application of heat and pressure by means of a roll fuser.

Although a preponderance of the toner forming the images is transferred to the paper during transfer, some toner remains on the photoreceptor surface, it being held thereto by relatively high electrostatic and/or mechanical forces. It is essential for optimum operation that the toner and debris remaining on the surface be cleaned thoroughly therefrom.

A commercially successful mode of cleaning employed in automatic xerography utilizes a brush with soft bristles which have suitable triboelectric characteristics. While the bristles are soft they are sufficiently firm to remove residual toner particles from the xerographic plate. In addition, webs or belts of soft fibrous or tacky materials and other cleaning systems are known.

More recent developments in the area of removing residual toner and debris from a charge retentive surface have resulted in cleaning structures which, in addition to relying on the physical contacting of the surface to be acted upon also rely on electrostatic fields established by electrically biasing one or more members of the cleaner system.

It has been found that establishing an electrostatic field between the charge retentive surface and the cleaning member such as a fiber brush or a magnetic brush enhances toner attraction to the cleaning brush surface. Such arrangements are disclosed in U.S. Pat. Nos. 3,572,923 and 3,722,018 granted to Fisher et al. on Mar. 22, 1973 and Fisher on Mar. 30, 1971, respectively. Likewise, when an electrostatic field is established between the brush and a brush detoning member, removal of toner from the brush is improved. The creation of the electrostatic field between the brush and photoreceptor is accomplished by applying a d.c. voltage to the brush. When the fibers or granules forming the brush are electrically conductive and a bias is applied thereto cleaning is observed to be more efficient than if the fibers or granules are non-conductive or insulative.

U.S. patent application Ser. No. 130,805 filed Mar. 17, 1980 in the name of Seanor et al. and assigned to the same assignee as this invention discloses a magnetic brush and insulative detoning roll both of which have electrical biases applied thereto for establishing the desired electrostatic fields between the brush and the photoreceptor and between the brush and detoning roll. This application was published in Brazil on Sept. 22, 1981.

The field established between the conductive brush and the insulative photoreceptor is such that the toner on the photoreceptor is attracted to the brush. Thus, if the toner on the photoreceptor is positively charged then the aforementioned field would be negative or less positive. In order to attract the toner from the brush onto the detoning roll, the detoning roll is electrically biased to the same polarity but a greater negative or less positive potential than the brush.

A device that is structurally similar to the Seanor device is disclosed in U.S. Pat. No. 4,116,555. However, that device has a biased brush for removing background toner from a photoreceptor and has two rolls for removing the background particles from the background removal brush and returning same to the developer sump. To that end the U.S. Pat. No. 4,116,555 device utilizes two detoning rolls which are biased to opposite polarities. In that way, both positive and negative toner in the background areas can be removed from the photoreceptor.

An improvement of the U.S. Pat. No. 4,116,555 device is disclosed in U.S. patent application Ser. No. 517,151 which is assigned to the same assignee as the instant application. In the device disclosed in the Ser. No. 517,151 application there are, as in the case of the U.S. Pat. No. 4,116,555 patent, provided two detoning rolls co-acting with an electrically biased brush for removal of residual toner from a charge-retentive surface such as a photoreceptor. However, the Ser. No. 517,151 device unlike the U.S. Pat. No. 4,116,555 device is utilized to, not only remove residual toner and debris from the surface, but to separate the debris from the toner so that the toner can be reused.

Pursuant to the improved features of the present invention, there is provided an electrostatically assisted magnetic cleaning brush for removing residual toner and debris from the surface of a charge-retentive surface. The toner and debris transferred to the magnetic cleaning brush is removed therefrom by a detoning roller having a conductive grid structure thereon which is designed to create a travelling electrostatic wave adjacent the surface thereof when alternating voltages of three or more phases are applied to the grid structure. The grid structure comprises an array of conductors which extend circumferentially around the roller such that adjacent conductors are connected to alternating voltages which are out of phase. Travelling waves are thus created which move axially along the roller. Charged toner having a predetermined diameter and charge which has been treated by a preclean corotron and is attracted to the detoning roller is quickly transported to one end of the detoning roller by the travelling wave where it is scraped from the roller and either collected in a container or transported to the developer housing. Particles which do not have the proper charge or diameter such as paper debris are cleaned from the surface of the detoning roller by means of a suitable blade.

Figure 2:
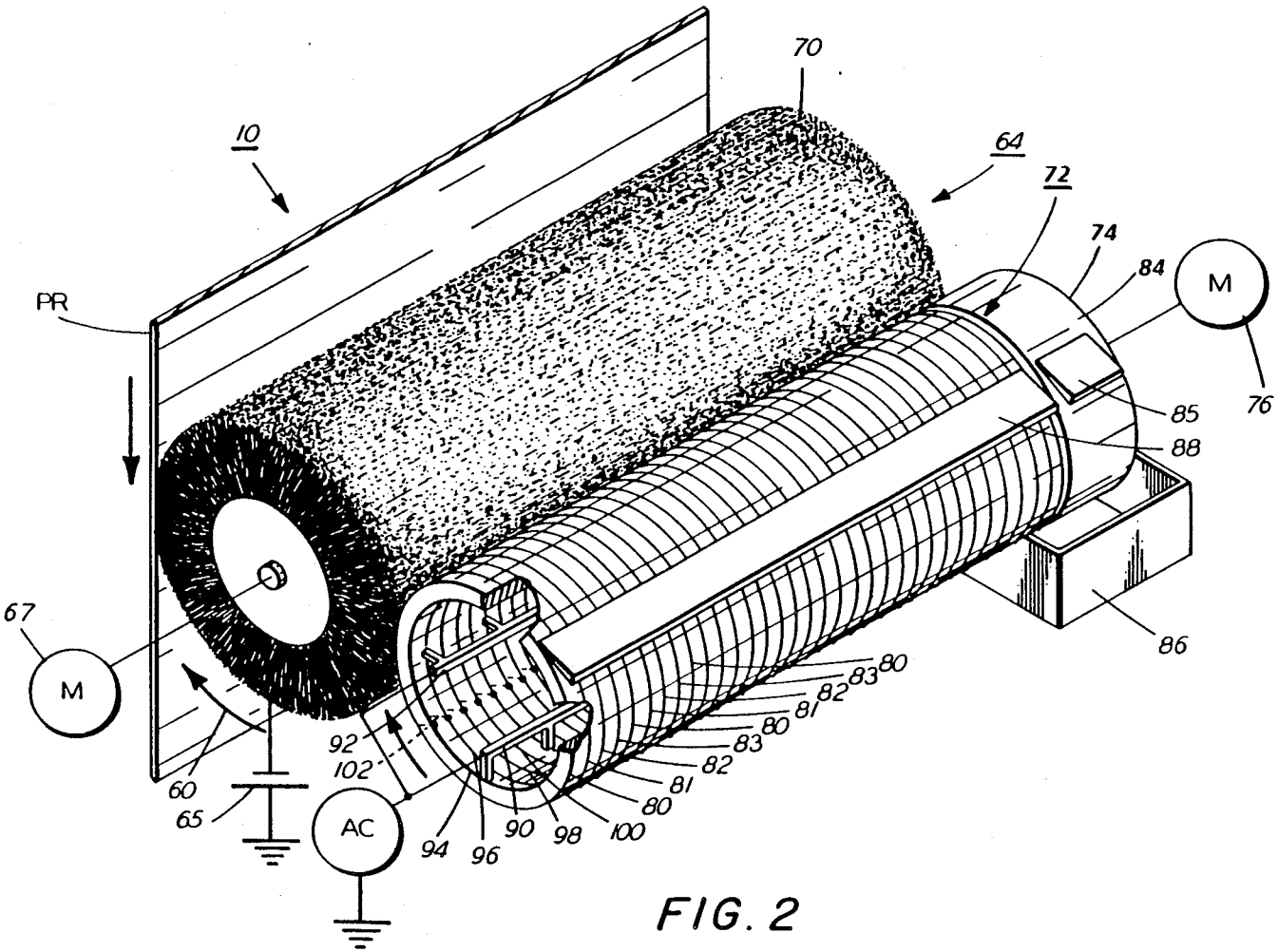

Other aspects of the present invention will become apparent as the following description proceeds with reference to the drawings wherein:

FIG. 1 is a schematic elevational view depicting an electrophotographic printing machine incorporating the present invention; and FIG. 2 is a schematic illustration of a cleaner incorporated in the machine of FIG. 1.

Inasmuch as the art of electrophotographic printing is well known, the various processing stations employed in the printing machine illustrated in FIG. 1 will be described only briefly.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having disclosed therein one or more diamines. A photoreceptor of this type is disclosed in U.S. Pat. No. 4,265,990 issued May 5, 1982 in the name of Milan Stolka et al., the disclosure of which is incorporated herein by reference. Belt 10 moves in the direction of arrow 16 to advance successive portions thereof sequentially through the various processing stations disposed about the path of movement thereof.

Belt 10 is entrained about stripping roller 18, tension roller 20 and drive roller 22. Roller 22 is coupled to motor 24 by suitable means such as a drive chain.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device, indicated generally by the reference numeral 25, charges layer 14 of belt 10 to a relatively high, substantially uniform negative potential. A suitable corona generating device for negatively charging the photoreceptor belt 10 comprises a conductive shield 26 and corona wire 27 the latter of which is coated with an electrically insulating layer 28 having a thickness which precludes a net d.c. corona current when an a.c. voltage is applied to the corona wire. Application of a suitable d.c. bias on the conductive shield 26 will result in a suitable charge being applied to the photoreceptor belt as it is advanced through exposure station B. At exposure station B, an original document 30 is positioned face down upon a transparent platen 32. The light rays reflected from original document 30 form images which are transmitted through lens 36. The light images are projected onto the charged portion of the photoreceptor belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoreceptor belt.

Belt 10 then advances the toner powder image to transfer station D. At transfer station D, a sheet of support material 40 is moved into contact with the toner powder images. The sheet of support material is advanced to transfer station D by a sheet forming apparatus 42. Preferably, sheet feeding apparatus 42 includes a feed roll 44 contacting the upper sheet of stack 46. Feed roll 44 rotates so as to advance the upper most sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner powder images are attracted from photoconductor belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator.

A preclean dicorotron 63 is provided for exposing the residual toner and contaminants to positive charges thereon so that a suitable biased cleaning roller, to be discussed hereinafter, will be more effective in removing them.

At a cleaning station F, residual particles such as toner and contaminants or debris such as paper fibers are removed from the photoreceptor surface by means of a magnetic brush 64 which is suitably biased by means of a power source 65 and which is rotated in the direction of the arrow 66 via motor 67.

The magnetic brush comprises cylindrical roller member 70 having magnets (not shown) disposed internally thereof which cause carrier beads (also not shown) to form brush-like structure which contacts the photoreceptor 10. The electrical bias applied to the brush 64 generates an electrostatic field between the brush and the photoreceptor which field assists in the removal of residual particles from the photoreceptor.

A detoning structure 72 is provided to continously remove the residual particles from the brush 64 so that it can continue to be effective in removing the particles from the photoreceptor. The detoning structure comprises an electrically insulated cylindrical member 74 supported for rotation by a motor 76. An array of conductive electrodes 80, 81, 82, and 83 are carried by the surface of the member 74. They form a conductive gridwork biased to a d.c. voltage of −100 to −500 volts relative to the magnetic brush bias voltage to attract residual particles from the brush to the detoning roll. A.c. voltages in the order of 200–600 volts (zero to peak value) and frequencies in the order of 1–3 kz are applied to the electrodes, the a.c. voltages being phase shifted on the different sets of electrodes so that a travelling wave pattern is created. The voltages are applied via finger commutators 90 and 92. There are actually four such commutators but only two are illustrated for sake of clarity. The commutators contact conductors 94, 96, 98 and 100 provided internally of the detoning structure 72. These conductors are electrically connected to the electrodes 80, 81, etc. via connectors represented by dotted lines 102. This causes residual particles having a predetermined diameter (i.e., 1–20 microns) and charge greater than 4 micro coulomb/gm. to be moved along the axis of the detoning structure 72 until they reach a collecting electrode 84 which holds the particles in place via electrostatic image forces until removed by a scraper blade 85 which causes the toner particles to be removed therefrom. The particles are collected in a container 86 for future reuse. Preferably four different phases with a 90° phase difference between adjacent electrodes are applied to the set of electrodes 80, 81, 82, 83.

Particles which do not have the proper size of diameter such as paper fiber remain disposed about the periphery of the detoning structure in the area of the electrodes. These particles are removed by means of a scraper blade 88 and are collected in a container (not shown) and later discarded.

The electrodes 80, 81, 82, and 83 are approximately 5 mils. wide and the space between adjacent electrodes is approximately 5 mils. A thin film (1–2 mils thick) having high dielectric strength and low coefficient of friction on the surface is conformably bound to the surface bearing the electrodes; a typical material is polyvinyl fluoride or polyimide. This surface overcoating is essential to prevent shorting from the electrodes to the brush, and to prevent shorting between electrodes.

A.c. voltages on the electrodes higher than 600V can generate corona on the surface and degrade the integrity of the grid structure and therefore should be avoided.

It should be noted that this invention performs equally satisfactorily when a conductive fiber brush is substituted for the magnetic brush as the cleaner.

It should now be appreciated that there has been described an improved electrostatically assisted device which is capable of effectively separating reusable toner from residual particles removed from a charge retentive surface..

What is claimed is:

1. Apparatus for removing charged particles comprising toner particles from a surface with subsequent separation of particles having a predetermined diameter and charge from the rest of the particles, said apparatus comprising:

an endless particle removal member supported adjacent said surface for movement in a first direction such that portions thereof move toward and away from said surface;

electrostatic detoning structure supported adjacent said endless particle removal member for movement relative thereto and for electrostatically attracting toner particles from said endless particle removal member;

means carried by said detoning structure for moving particles having said predetermined diameter and charge in a direction substantially perpendicular to said first direction.

2. Apparatus according to claim 1 wherein said surface comprises a charge-retentive surface.

3. Apparatus according to claim 1 wherein said charge retentive surface comprises a photoreceptor.

4. Apparatus according to claim 3 wherein said means carried by said detoning structure comprises a conductive grid structure adapted to create a travelling electrostatic wave for moving said particles having said predetermined diameter and charge.

5. Apparatus according to claim 3 wherein said endless particle removal member comprises a cylindrically-shaped magnetic brush.

6. Apparatus according to claim 5 wherein said detoning structure comprises a roller member.

7. Apparatus according to claim 6 wherein said means carried by said detoning structure comprises a conductive grid structure and further including a voltage source connected to said grid structure in such a manner as to create a travelling electrostatic wave which moves said particles having said predetermined diameter and charge axially along said detoning structure.

8. Apparatus according to claim 7 including a blade disposed adajcent one end of said detoning structure for removing the particles moved there by said travelling electrostatic wave.

9. Apparatus according to claim 8 including means for removing particles from the surface of said detoning structure which are not moved to said one end.

10. Apparatus according to claim 9 wherein said voltage source comprises a source of a.c. power and said conductive grid structure comprises an array of conductors wrapped about the circumference of said detoning roller, said a.c. power source being connected to said conductors such that the a.c. voltages of adjacent conductors are out of phase.

11. Apparatus according to claim 10 wherein said a.c. power source has a zero to peak value in the order of 200 to 600 volts.

12. Apparatus according to claim 11 wherein the spacing between centers of said conductors is approximately 10 mils.

13. Apparatus according to claim 12 wherein the spacing between adjacent conductors is approximately equal to the width of one conductor.

14. Apparatus according to claim 13 wherein the width of each conductor is 5 mils.

15. Apparatus according to claim 14 wherein said conductors are covered with a polyvinylfluoride or polyimide film.

16. Apparatus for removing charged particles comprising toner particles from a surface with subsequent separation of particles having a predetermined diameter and charge from the rest of the particles, said apparatus comprising:

an endless particle removal member supported adjacent said surface for movement in a first direction such that portions thereof move toward and away from said surface;

detoning structure supported adjacent sid endless particle removal member for movement relative thereto;

means carried by said detoning structure for moving particles having said predetermined diameter and charge in a direction substantially perpendicular to said first direction, said means carried by said detoning structure comprising a conductive grid structure adapted to create a travelling electrostatic wave for moving said particles having said predetermined diameter and charge.

17. Apparatus for removing charged particles comprising toner particles from a charge retentive surface with subsequent separation of particles having a predetermined diameter and charge from the rest of the particles, said apparatus comprising:

a cylindrically-shaped magnetic brush particle removal member supported adjacent said surface for movement in a first direction such that portions thereof move toward and away from said surface;

a detoning structure in the shape of a roller supported adjacent said endless particle removal member for movement relative thereto;

means carried by said detoning structure for moving particles having said predetermined diameter and charge in a direction substantially perpendicular to said first direction, said means carried by said detoning structure comprising a conductive grid structure and further including a voltage source connected to said grid structure in such a manner as to create a travelling electrostatic wave which moves said particles having said predetermined diameter and charge axially along said detoning structure.

* * * * *